US010847943B2

(12) United States Patent
Weber et al.

(10) Patent No.: US 10,847,943 B2
(45) Date of Patent: Nov. 24, 2020

(54) 4-WAY INDENT TOOL

(71) Applicant: TE CONNECTIVITY CORPORATION, Berwyn, PA (US)

(72) Inventors: Tyler Benjamin Weber, Manheim, PA (US); Richard Lloyd Schaeffer, Carlisle, PA (US)

(73) Assignee: TE Connectivity Corporation, Berwyn, PA (US)

( * ) Notice: Subject to any disclaimer, the term of this patent is extended or adjusted under 35 U.S.C. 154(b) by 378 days.

(21) Appl. No.: 15/832,084

(22) Filed: Dec. 5, 2017

(65) Prior Publication Data

US 2019/0168365 A1 Jun. 6, 2019

(51) Int. Cl.

*H01R 43/042* (2006.01)
*H01R 43/058* (2006.01)
*H01R 43/048* (2006.01)

(52) U.S. Cl.

CPC ..... *H01R 43/0428* (2013.01); *H01R 43/0424* (2013.01); *H01R 43/0488* (2013.01); *H01R 43/0585* (2013.01)

(58) Field of Classification Search

CPC ..... H01R 43/0424; H01R 43/0428; H01R 43/0488; H01R 43/04585

USPC ..... 29/243.53, 243.56; 74/53, 54, 55, 89.23, 74/107, 127, 568 R; 269/24, 25, 26, 27, 269/32, 228

See application file for complete search history.

(56) References Cited

U.S. PATENT DOCUMENTS 3,086,574 A * 4/1963 Ustin ..... H01R 43/0585 72/402
3,174,323 A * 3/1965 Over ..... H01R 43/0427 72/412
3,199,334 A 8/1965 Holmes et al.
3,199,337 A * 8/1965 Ginn ..... H01R 43/0427 72/416
3,397,567 A * 8/1968 Klinger ..... H01R 43/0428 72/416
3,459,029 A 8/1969 Rosenfeld et al.
3,464,527 A * 9/1969 Baker ..... H01R 43/033 192/72
3,693,254 A * 9/1972 Salonen ..... A01G 3/033 30/228
4,774,762 A * 10/1988 Gobeil ..... B25B 27/146 29/751
4,932,237 A * 6/1990 Hatfield ..... H01R 43/0428 29/751
5,111,681 A * 5/1992 Yasui ..... B25B 27/146 29/751
5,490,801 A 2/1996 Fisher, Jr. et al.

(Continued)

*Primary Examiner* — Adam J Eiseman
*Assistant Examiner* — Stephen Floyd London

(57) ABSTRACT

A 4-way indent tool includes a indenter actuator cam arm being movable between an unactuated position and an actuated position to actuate four indenters to crimp a terminal. The 4-way indent tool includes a drive assembly movable along the drive screw between a retracted position and an advanced position. The drive assembly has a drive nut on a drive screw and a coupler operably coupled between the drive nut and the indenter actuator cam arm. The coupler moves the indenter actuator cam arm. The coupler has a spring loaded coupling between the drive nut and the indenter actuator cam arm compressed as the coupler is moved between the retracted position and the advanced position.

20 Claims, 4 Drawing Sheets

(56) References Cited

U.S. PATENT DOCUMENTS

| | | | | | |
|---|---|---|---|---|---|
| 5,558,166 | A * | 9/1996 | Chen | B23D 29/002 | 173/216 |
| 5,657,417 | A | 8/1997 | Di Troia | | |
| 5,680,788 | A * | 10/1997 | Kootte | B25B 7/126 | 72/452.8 |
| 5,727,417 | A | 3/1998 | Moffatt et al. | | |
| 5,735,353 | A * | 4/1998 | Undin | B25B 7/00 | 173/11 |
| 6,138,346 | A * | 10/2000 | Shutts | B25B 7/126 | 29/741 |
| 7,254,982 | B2 | 8/2007 | Frenken | | |
| D767,959 | S | 10/2016 | Sokat et al. | | |
| 2006/0272381 | A1* | 12/2006 | Ayer | B25B 27/10 | 72/453.16 |
| 2008/0276678 | A1 | 11/2008 | PAcaud et al. | | |
| 2010/0314226 | A1 | 12/2010 | Kelly | | |
| 2013/0240228 | A1* | 9/2013 | Lefavour | B25B 27/146 | 173/20 |
| 2015/0288125 | A1* | 10/2015 | Sneath | F16K 15/042 | 60/428 |

* cited by examiner

4-WAY INDENT TOOL

BACKGROUND OF THE INVENTION

The subject matter herein relates generally to a 4-way indent tool.

Tools are used to attach terminals to ends of wires. For example, crimp tools are known for crimping the terminal to the wire. Some tools, known as 4-way indent tools, provide four indenters arranged at orthogonal positions that are driven into the terminal to crimp the terminal in four different positions. Some conventional 4-way indent tools are hand powered, which may lead to inconsistent crimps and operator fatigue. Other known 4-way indent tools are hydraulic or pneumatic powered. However, the hydraulic tools are heavy and may difficult to use. The pneumatic tools must be connected to an air hose, and are thus limited in their use.

A need remains for a light-weight tool providing flexibility in use having repeatable and reliable operation.

BRIEF DESCRIPTION OF THE INVENTION

In one embodiment, a 4-way indent tool is provided including a cover having a base and a head. The base holds a motor driven by a power source. The cover holds a drive screw operably coupled to the motor and being rotated by the motor when the motor is operated. The 4-way indent tool includes an indenter holder at the head holding four indenters positioned orthogonally around a terminal opening configured to receive a terminal. The indenters are actuated to move relative to the terminal opening to crimp the terminal received in the terminal opening. The 4-way indent tool includes a indenter actuator cam arm positioned adjacent the indenter holder to operably engage the indenters. The indenter actuator cam arm is movable between an unactuated position and an actuated position. The indenter actuator cam arm has cam surfaces engaging the corresponding indenters to actuate the indenters as the indenter actuator cam arm moves to the actuated position. The 4-way indent tool includes a drive assembly movable along the drive screw between a retracted position and an advanced position. The drive assembly has a drive nut threadably coupled to the drive screw and a coupler operably coupled between the drive nut and the indenter actuator cam arm. The coupler moves the indenter actuator cam arm between the unactuated position and the actuated position as the coupler is moved between the retracted and advanced positions. The coupler has a spring loaded coupling between the drive nut and the indenter actuator cam arm compressed as the coupler is moved between the retracted position and the advanced position.

In another embodiment, a 4-way indent tool is provided including a cover having a base and a head. The base holds a motor driven by a power source. The cover holds a drive screw operably coupled to the motor and being rotated by the motor when the motor is operated. The 4-way indent tool includes an indenter holder at the head holding four indenters positioned orthogonally around a terminal opening configured to receive a terminal. The indenters are actuated to move relative to the terminal opening to crimp the terminal received in the terminal opening. The 4-way indent tool includes a indenter actuator cam arm positioned adjacent the indenter holder to operably engage the indenters. The indenter actuator cam arm is movable between an unactuated position and an actuated position. The indenter actuator cam arm has cam surfaces engaging the corresponding indenters to actuate the indenters as the indenter actuator cam arm moves to the actuated position. The 4-way indent tool includes a drive assembly movable along the drive screw between a retracted position and an advanced position. The drive assembly has a drive nut threadably coupled to the drive screw and a coupler operably coupled between the drive nut and the indenter actuator cam arm. The coupler moves the indenter actuator cam arm between the unactuated position and the actuated position as the coupler is moved between the retracted and advanced positions. The coupler is configured to decouple the cam lever arm from the drive nut when the indenter actuator cam arm is in the actuated position to allow the coupler to continue moving to the advanced position without further moving the indenter actuator cam arm beyond the actuated position.

In a further embodiment, a 4-way indent tool is provided including a cover having a base and a head. The base holds a motor driven by a power source. The cover holds a drive screw operably coupled to the motor and being rotated by the motor when the motor is operated. The 4-way indent tool includes an indenter holder at the head holding four indenters positioned orthogonally around a terminal opening configured to receive a terminal. The indenters are actuated to move relative to the terminal opening to crimp the terminal received in the terminal opening. The 4-way indent tool includes a crimp height adjustment mechanism variably positionable relative to the head. The 4-way indent tool includes a indenter actuator cam arm positioned adjacent the indenter holder to operably engage the indenters. The indenter actuator cam arm is movable between an unactuated position and an actuated position. The indenter actuator cam arm has cam surfaces engaging the corresponding indenters to actuate the indenters as the indenter actuator cam arm moves to the actuated position. The indenter actuator cam arm bottoms out against the crimp height adjustment mechanism in the actuated position. The actuated position is variable and controlled by the position of the crimp height adjustment mechanism. The 4-way indent tool includes a drive assembly movable along the drive screw between a retracted position and an advanced position. The drive assembly has a drive nut threadably coupled to the drive screw and a coupler operably coupled between the drive nut and the indenter actuator cam arm. The coupler moves the indenter actuator cam arm between the unactuated position and the actuated position as the coupler is moved between the retracted and advanced positions. The coupler has a spring loaded coupling between the drive nut and the indenter actuator cam arm compressed after the indenter actuator cam arm bottoms out against the crimp height adjustment mechanism as the coupler continues to move toward the advanced position.

DETAILED DESCRIPTION OF THE INVENTION

Figure 1:
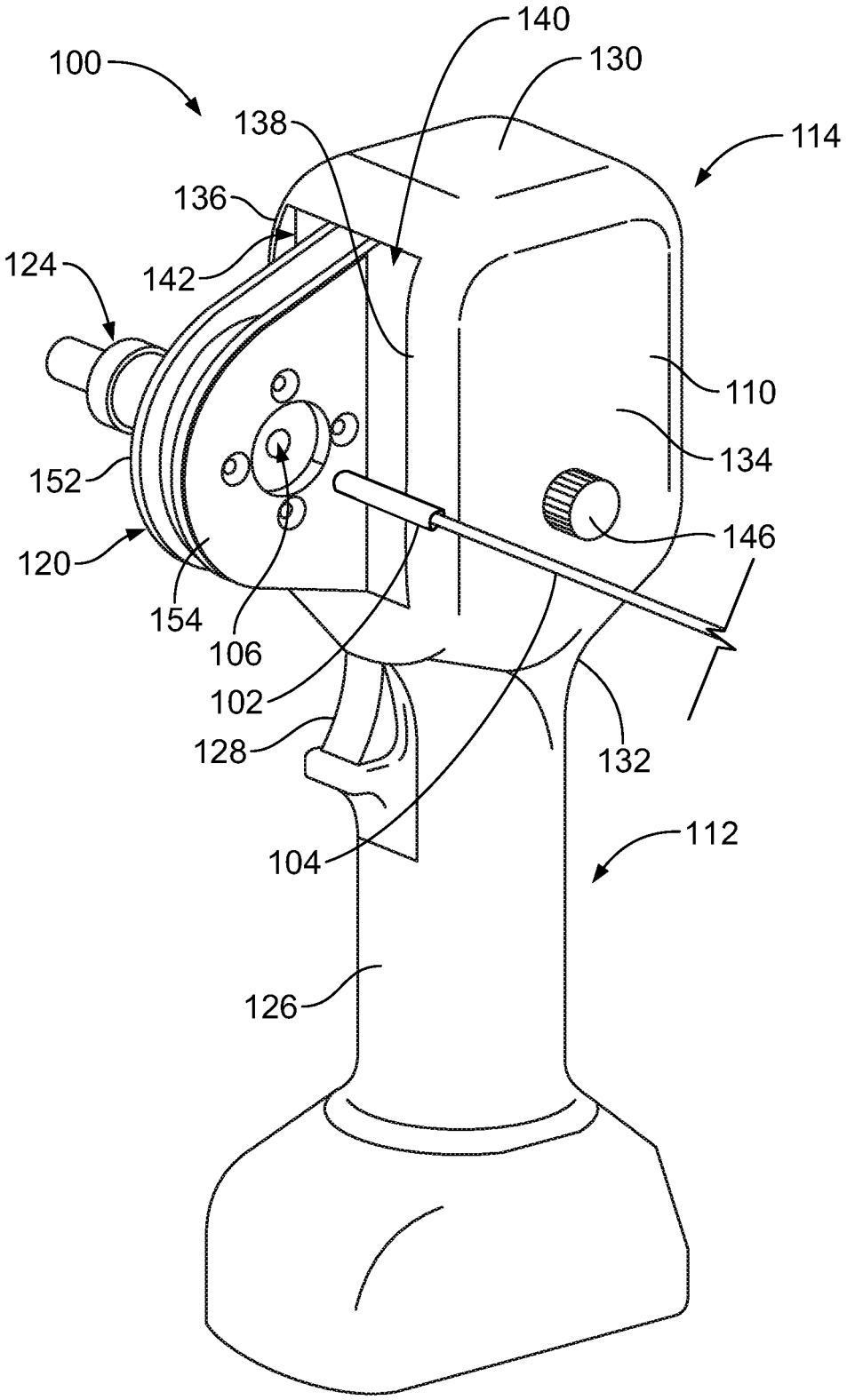
FIG. 1 is a perspective view of a 4-way indent tool in accordance with an exemplary embodiment.
Figure 2:
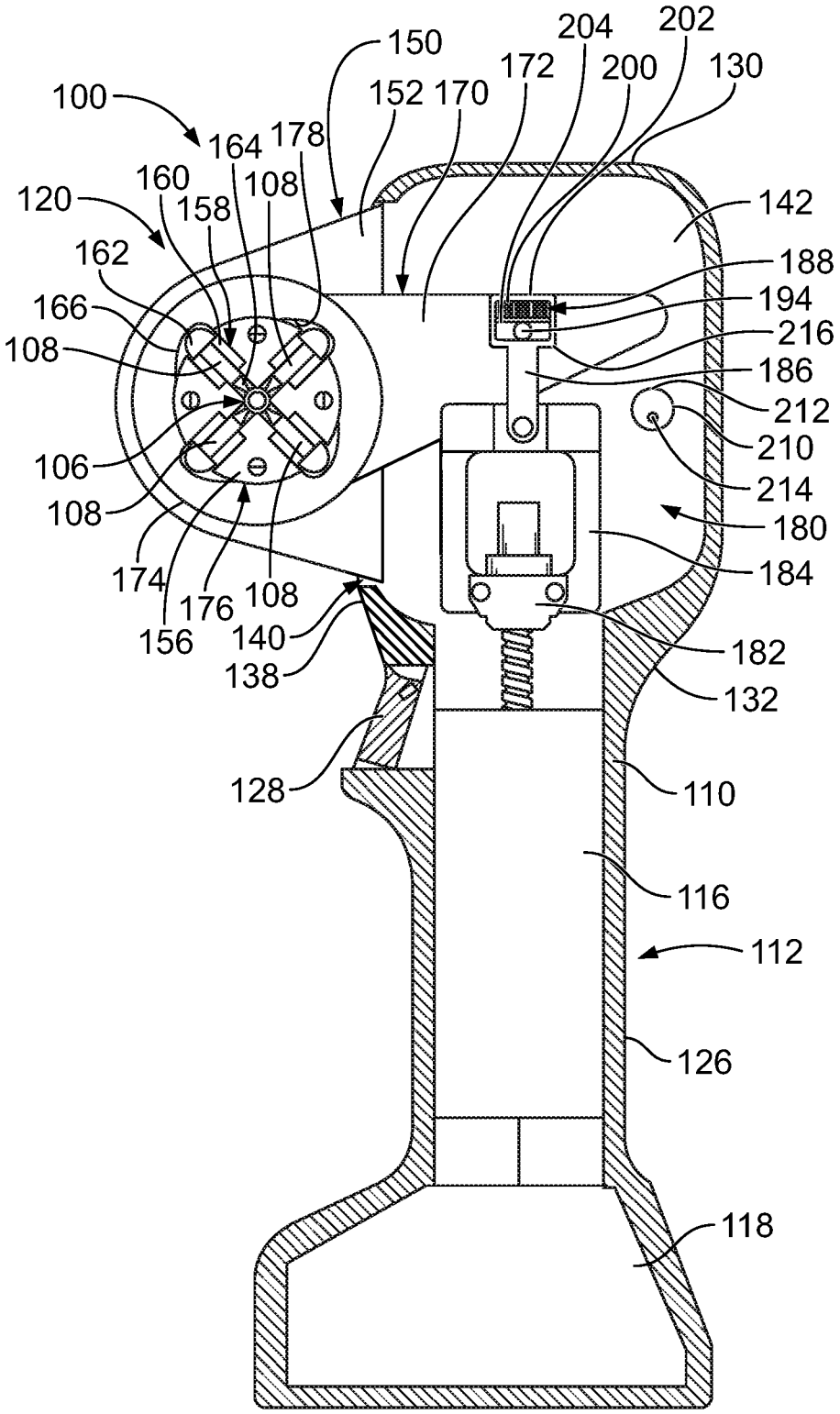
FIG. 2 is a partial sectional view of the 4-way indent tool in accordance with an exemplary embodiment.

FIG. 1 is a perspective view of a 4-way indent tool 100 in accordance with an exemplary embodiment. FIG. 2 is a partial sectional view of the 4-way indent tool 100 in accordance with an exemplary embodiment. In an exemplary embodiment, the 4-way indent tool 100 is used to crimp a terminal 102 to a wire 104. The terminal 102 and the wire 104 are loaded into a terminal opening 106 in the 4-way indent tool 100 and the 4-way indent tool 100 is operated to actuate four indenters 108 (FIG. 2) to crimp the terminal 102 to the wire 104 at four orthogonal locations around the terminal 102. In an exemplary embodiment, the 4-way indent tool 100 is battery operated. In an exemplary embodiment, the 4-way indent tool 100 has a mechanical drive for driving the indenters 108.

The 4-way indent tool 100 includes a cover or cover 110 having a base 112 and a head 114. The base 112 holds a motor 116 (FIG. 2), such as an electric motor, driven by a power source 118 (FIG. 2), such as a battery. In various embodiments, the motor 116 includes a gearbox. The cover 110 holds an indenter assembly 120 including the indenters 108. The cover 110 holds a drive screw 122 (FIG. 2) operably coupled to the motor 116 and being rotated by the motor 116 when the motor 116 is operated to drive the indenter assembly 120 and actuate the indenters 108.

The indenter assembly 120 includes the terminal opening 106 configured to receive the terminal 102. The indenter assembly 120 includes a terminal locator 124 aligned with the terminal opening 106 for locating the terminal 102 and the terminal opening 106. In an exemplary embodiment, the terminal locator 124 is adjustable to adjust the position of the terminal 102 and the terminal opening 106 (for example, to control a depth of receipt of the terminal 102 in the terminal opening 106).

The base 112 of the cover 110 includes a handle 126 configured to be held by the operator. The base 112 of the cover 110 includes a trigger 128 for operating the 4-way indent tool 100. The trigger 128 is operably coupled to the motor 116 to drive the motor 116. Optionally, the trigger 128 may have a forward drive and a reverse drive for the motor 116. The 4-way indent tool 100 includes a control system for controlling operation of the motor 116, such as to control a direction of the motor 116, a speed of the motor 116, an operating time or distance of the motor 116 (such as to control a number of revolutions of the motor during an advancing or retracting operation), and the like. In the illustrated embodiment, the power source 118 is located at the bottom of the handle 126 to balance the weight of the 4-way indent tool 100 between the power source 118 at the bottom and the head 114 at the top.

The head 114 extends between a top 130 and a bottom 132. The head 114 has a front 134 and a rear 136. The head 114 includes an open side 138 having a cover opening 140 to a cavity 142. The indenter assembly 120 is positioned in the cavity 142. The indenter assembly 120 extends from the side 138 through the cover opening 140. The cover 110 encloses components of the indenter assembly 120 between the top 130 and the bottom 132 and between the front 134 and the rear 136. In an exemplary embodiment, the head 114 holds a crimp height adjustment mechanism 146, which is accessible at an exterior of the cover 110. The crimp height adjustment mechanism 146 is adjustable to control a crimp height of the indenters 108 when the 4-way indent tool 100 is operated.

The indenter assembly 120 includes an indenter holder assembly 150 at the head 114 configured to hold the indenters 108. In the illustrated embodiment, the indenter holder assembly 150 includes first and second crimp head side plates 152, 154. The side plates 152, 154 are mounted to the cover 110 within the cavity 142 and extend from the side 138 through the cover opening 140. The side plates 152, 154 define the terminal opening 106. The indenter holder assembly 150 includes an indenter holder 156 between the side plates 152, 154. The indenter holder 156 includes four indenter channels 158 receiving corresponding indenters 108. The indenter channels 158 are arranged at four orthogonal positions to hold the indenters 108 at the orthogonal positions around the terminal opening 106. In an exemplary embodiment, the biasing mechanisms 160 are received in the indenter channels 158 and engage the indenters 108 to bias the indenters 108 radially outward away from the terminal opening 106. For example, each biasing mechanism 160 engages an indenter cam 162 of the corresponding indenter 108 to press a indenter tip 164 of the corresponding indenter 108 outward away from the terminal opening 106. The indenter cam 162 includes a ramp or cam surface 166 at the radially outer end of the indenter 108 configured to be engaged by the indenter assembly 120 to actuate the indenter 108 during the crimping process.

The 4-way indent tool 100 includes a indenter actuator cam arm 170 positioned adjacent the indenter holder assembly 150 to operably engage the indenters 108. For example, the indenter actuator cam arm 170 is positioned between the first and second side plates 152, 154. The indenter actuator cam arm includes a cam lever arm 172 and an indenter actuator cam head 174 opposite the cam lever arm 172. The indenter actuator cam head 174 includes an indenter holder pocket 176 receiving the indenter holder 156 and the indenters 108. The indenter actuator cam arm 170 includes cam surfaces defined in the pocket 176. Each indenter actuator cam surface 178 engages the cam surface 166 of the corresponding indenter 108. As the indenter actuator cam arm 170 is rotated, the cam surfaces 178 drive the indenters 108 radially inward, pressing the indenter tips 164 into the terminal 102 received in the terminal opening 106.

Figure 3:
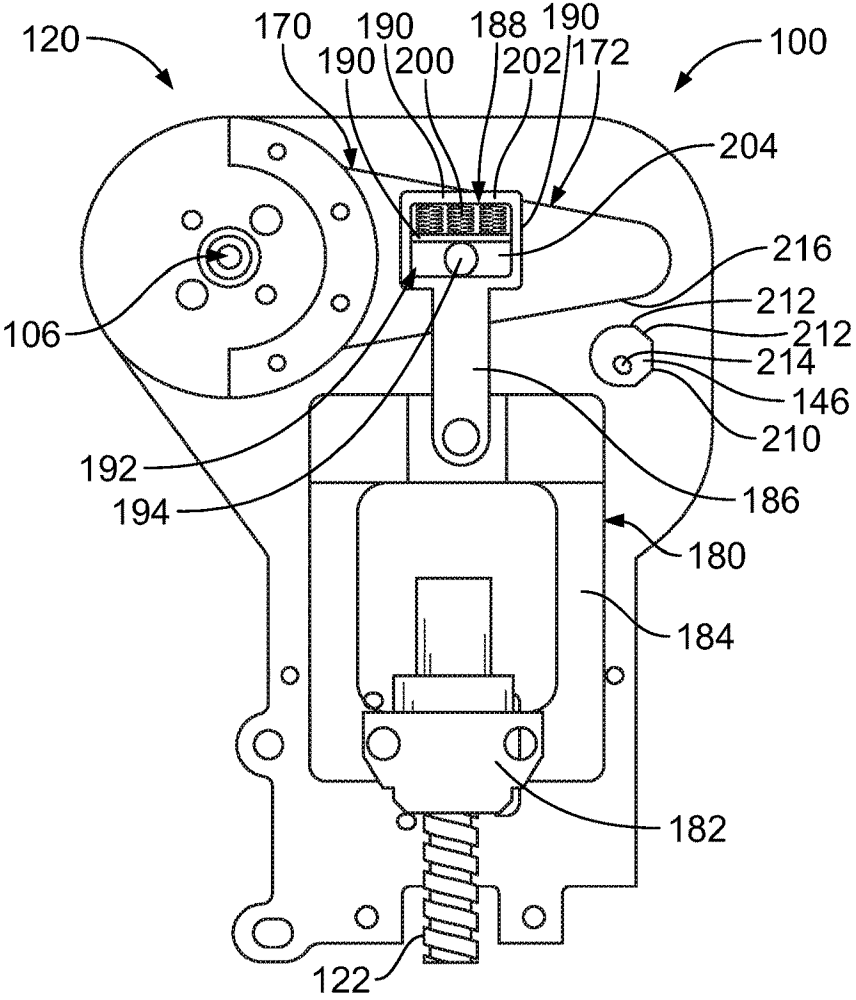
FIG. 3 is a side, partial sectional view of a portion of the 4-way indent tool showing a drive assembly in a retracted position and a indenter actuator cam arm in an unactuated position.

With additional reference to FIG. 3, which is a partial sectional, perspective view of a portion of the 4-way indent tool 100 with the cover 110 removed, the 4-way indent tool 100 includes a drive assembly 180 operably coupled to the drive screw 122. The drive assembly 180 includes a drive nut 182 threadably coupled to the drive screw 122. The drive assembly 180 includes a yoke 184 coupled to the drive nut 182, such as fixed at one or more mounting locations using fasteners. The drive assembly 180 includes a coupler 186 coupled between the yoke 184 and the indenter actuator cam arm 170. For example, the coupler 186 may be pivotably coupled to the yoke 184 at a pin. The coupler 186 is operably coupled between the drive nut 182 and the indenter actuator cam arm 170 and transfers movement of the drive nut 182 to the indenter actuator cam arm 170. The cam lever arm 172 is coupled to the coupler 186 and is movable with the coupler 186, the yoke 184 and the drive nut 182.

In the illustrated embodiment, the drive nut 182 includes a threaded bore extending between a top and a bottom of the drive nut 182. The threaded bore is threadably coupled to the drive screw 122. The drive nut 182 is moved linearly on the drive screw 122 as the drive screw 122 is rotated, which drives the indenter actuator cam arm 170 to actuate the indenters 108. The drive nut 182 is returned along the drive screw 122 after the terminal 102 is crimped.

The drive assembly 180 is movable between a retracted position and an advanced position. For example, the retracted position may be at or near a top of the drive screw 122 and the advanced position may be at or near a bottom of the drive screw 122. The drive assembly 180 is moved downward along the drive screw 122 between the retracted position and the advanced position. However, in alternative embodiments, the drive assembly 180 may be moved upward along the drive screw 122 between the retracted position and the advanced position. As the drive assembly 180 moves between the retracted position and the advanced position, the indenter actuator cam arm 170 is rotated between an unactuated position and an actuated position. In the unactuated position, the indenters 108 are in their normal resting position (for example, pressed radially outward by the biasing mechanisms 160). In the actuated position, the indenters 108 are driven radially inward by the cam surfaces 178 of the indenter actuator cam arm 170.

In an exemplary embodiment, the coupler 186 includes a spring-loaded coupling 188. The spring-loaded coupling 188 is located in the mechanical linkage between the drive nut 182 and the indenter actuator cam arm 170. For example, in the illustrated embodiment, the spring-loaded coupling 188 is located between the coupler 186 and the indenter actuator cam arm 170. However, in alternative embodiments, the spring-loaded coupling 188 may be located at another location, such as between the yoke 184 and the coupler 186. The spring-loaded coupler 188 is configured to decouple the mechanical linkage at a location between the drive nut 182 and the indenter actuator cam arm 170 to allow the drive nut 182 to continue moving in the advancing direction without further moving of the indenter actuator cam arm 170 beyond a predetermined position, such as the actuated position. For example, as the drive nut 182 continues to move along the drive screw 122, the yoke 184 moves with the drive nut 182 and the coupler 186 moves with the yoke 184 and the drive nut 182. However, the spring-loaded coupling 188 is compressible during movement of the drive nut 182, the yoke 184 and the coupler 186 when the indenter actuator cam arm 170 is in the fully actuated position. As such, the indenter actuator cam arm 170 is not over torqued during the operation of the 4-way indent tool 100, which could cause the indenters 108 to over crimp the terminal 102. Rather, the indenter actuator cam arm 170 stops at the actuated position and the spring-loaded coupling 188 allows the drive assembly 180 to continue advancing.

In an exemplary embodiment, the coupler 186 includes frame members 190 surrounding a pocket 192. The spring-loaded coupling 188 is positioned in the pocket 192. In an exemplary embodiment, a coupling member 194 of the indenter actuator cam arm 170 extends into the pocket 192 to engage the spring-loaded coupling 188. In the illustrated embodiment, the coupling member 194 is a post extending from a side of the cam lever arm 172; however, other types of coupling members 194 may be provided in alternative embodiments. The coupling member 194 is movable within the pocket 192, such as during the coupling of the drive assembly 180 from the indenter actuator cam arm 170 when the spring-loaded coupling 188 is compressed. In an exemplary embodiment, the spring-loaded coupling 188 includes one or more springs 200, such as coil springs, positioned between a first coupling plate 202 and a second coupling plate 204. In the illustrated embodiment, the first coupling plate 202 is defined by one of the frame members 190 of the coupler 186, such as the top frame member extending at the top of the coupler 186. The second coupling plate 204 is movable relative to the first coupling plate 202. In an exemplary embodiment, the coupling member 194 engages the second coupling plate 204. For example, the coupling member 194 is positioned between the second coupling plate 204 and one of the frame members 190 of the coupler 186.

In the illustrated embodiment, the spring-loaded coupling 188 is located above the coupling member 194; however, other positions are possible in alternative embodiments. The springs 200 are compressible between the first coupling plate 202 and the second coupling plate 204 as the coupler 186 is moved between the retracted position and the advanced position. For example, the springs 200 may be compressed when the second coupling plate 204 is pulled downward against the coupling member 194 when the indenter actuator cam arm 170 is in the actuated position. Prior to the indenter actuator cam arm 170 being in the actuated position, the second coupling plate 204 may pull against the coupling member 194 to rotate the indenter actuator cam arm 170 downward toward the actuated position. In an exemplary embodiment, the indenter actuator cam arm 170 may be pulled downward until the indenter actuator cam arm 170 engages the crimp height adjustment mechanism 146. The indenter actuator cam arm 170 bottoms out against the crimp height adjustment mechanism 146 in the actuated position. The crimp height adjustment mechanism 146 may include a disk, a dial, a knob, a lever or another type of mechanism for adjusting the crimp height adjustment mechanism 146. The drive assembly 180 is unable to move the indenter actuator cam arm 170 further than the actuated position when the indenter actuator cam arm 170 is bottomed out against the crimp height adjustment mechanism 146. Further movement of the drive assembly 180 in the advancing direction compresses the springs 200 without moving the indenter actuator cam arm 170. As such, the spring-loaded coupling 188 is configured to decouple the drive assembly 180 from the indenter actuator cam arm 170 when the indenter actuator cam arm 170 is in the actuated position to allow the coupler 186 to continue moving to the advanced position without further moving the indenter actuator cam arm 170 beyond the actuated position.

In an exemplary embodiment, the crimp height adjustment mechanism 146 includes an eccentric dial 210 having a plurality of stop surfaces 212 around the exterior of the dial 210. The stop surfaces 212 may be at different radial positions from a rotation axis 214 of the eccentric dial 210. The crimp height adjustment mechanism 146 is variably positionable relative to the head 114. For example, the eccentric dial 210 of the crimp height adjustment mechanism 146 may be rotated relative to the head 114 to change a crimp height of the indenters 108. For example, the crimp height adjustment mechanism 146 may control a stop height of the indenter actuator cam arm 170 by selecting one of the stop surfaces 212 to be aligned with the indenter actuator cam arm 170. The indenter actuator cam arm 170 includes a locating surface 216 configured to engage the stop surface 212 at the stop location (for example, the top of the eccentric dial 210). The stop height of the stop surface 212 controls the amount of rotation of the indenter actuator cam arm 170, and thus the distance that the indenters 108 are forced inward into the terminal opening 106.

During operation, the drive nut 182 is driven downward along the drive screw 122 and pulls the yoke 184 and the coupler 186 downward with the drive nut 182 from the retracted position to the advanced position. In the illustrated embodiment, the drive assembly 180 is advanced in a downward direction. The spring-loaded coupling 188 is advanced with the coupler 186 such that the second coupling plate 204 pulls the coupling member 194 downward to rotate the indenter actuator cam arm 170. The indenters 108 are driven inward to crimp the terminal as the indenter actuator cam arm 170 is rotated from the unactuated position to the actuated position. The indenter actuator cam arm 170 is rotated until the locating surface 216 engages the stop surface 212 of the crimp height adjustment mechanism 146. The crimp height adjustment mechanism 146 defines a travel stop for the indenter actuator cam arm 170. Further advancing and movement of the drive assembly 180 causes the springs 200 to compress, allowing the drive assembly 180 to advance through a full drive stroke of the motor 116. The motor 116 will then reverse to retract the drive assembly 180 forcing the drive assembly 180 upward to allow the indenter actuator cam arm 170 to return to the unactuated position. Optionally, the 4-way indent tool 100 may include a limit switch to limit advancing of the drive assembly 180.

In various embodiments, the control system of the 4-way indent tool 100 may include a sensor, such as a current sensor configured to sense a current consumption of the motor, such as to determine the status of the overall system. The sensor may sense a current spike or high current reading during the crimp cycle that is incongruent with normal operation (for example, above a threshold). The control system may stop the operation or enter an error mode and notify the operator that the tool is jammed or there is another type of error condition. Optionally, the control system may include limit switches, a motor encoder, a timing mechanism or another type of mechanism to determine the position of the drive nut, the length of the stroke, how far to return the drive nut to return the tool to the unactuated position after completing a crimp cycle or error reading, and the like. Operation of the motor may be controlled based on readings from such mechanisms. The control system may include a crimp force monitoring module to monitor the crimping force, such as through a strain gauge, a piezo sensor, a current sensor, and the like.

In an exemplary embodiment, the control system may include a certified crimp feature to ensure that the 4-way indent tool 100 completes the entire crimp cycle or will provide an error message to the operator if unable to complete the crimp cycle before a new crimp can be made. Such certified crimp feature allows the operator to ensure that high quality, precision crimps are produced by the 4-way indent tool 100 and allows the 4-way indent tool 100 to indicate to the operator when a faulty crimp occurs so such crimp can be discarded. Optionally, the 4-way indent tool 100 may include a communication module for wireless communication with a wireless network or other device, such as through wifi, Bluetooth, GPs, cellular communication, and the like to transmit and/or receive data. For example, the 4-way indent tool 100 may transmit data relating to the crimps to a database, such as position, time, cycle count, and the like. The 4-way indent tool 100 may receive set-up and/or crimping parameters (for example, length of crimp stroke, crimp force, terminal type, wire type, and the like).

In various embodiments, to change the height of the actuated position, the crimp height adjustment mechanism 146 may be rotated such that a different stop surface 212 having different radial height may be aligned with the locating surface 216. For example, one stop surface 212 may be aligned with the locating surface 216 when the crimp height adjustment mechanism 146 is in a first position, but a different stop surface 212 may be aligned with the locating surface 216 when the crimp height adjustment mechanism 146 is in a second position to change the length of the cam stroke of the indenter actuator cam arm 170.

Figure 4:
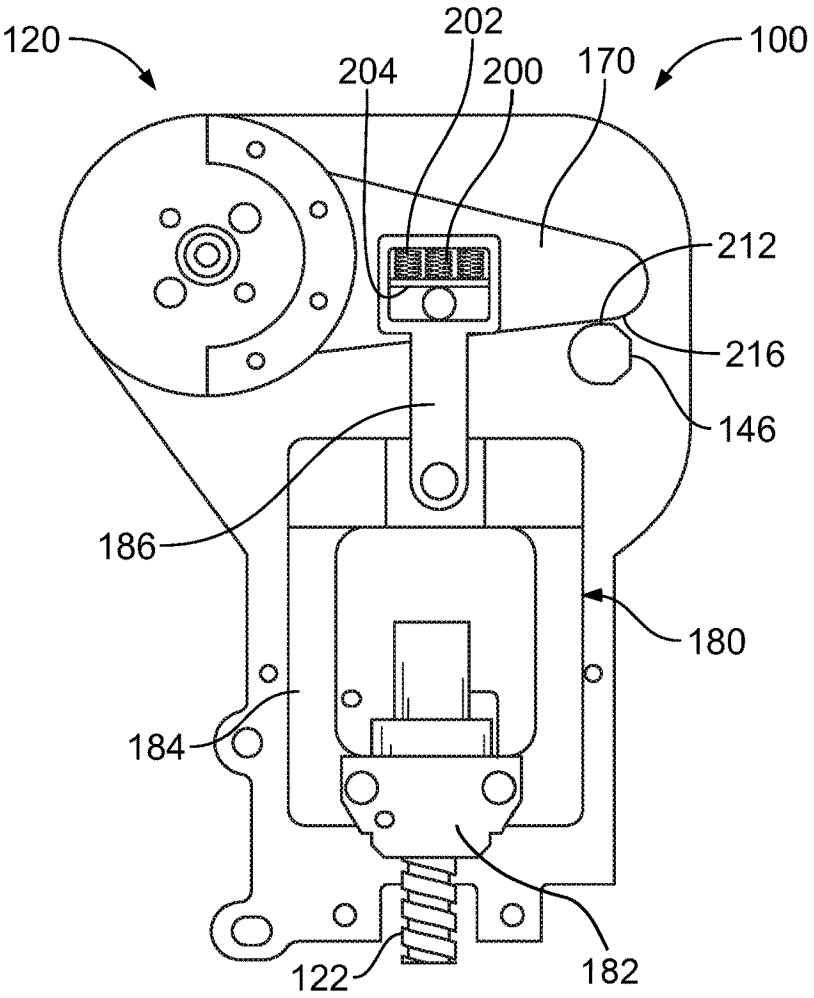
FIG. 4 is a side, partial sectional view of a portion of the 4-way indent tool showing the drive assembly in an advanced position and the indenter actuator cam arm in an actuated position.

FIG. 4 is a side, partial sectional view of a portion of the 4-way indent tool 100 showing the drive assembly 180 in the advanced position and the indenter actuator cam arm in the actuated position. The motor 116 (shown in FIG. 2) is operated to rotate the drive screw 122 to move the drive nut 182, the yoke 184 and the coupler 186 downward to force rotation of the indenter actuator cam arm 170. The indenter actuator cam arm 170 actuates the indenters 108 as the indenter actuator cam arm 170 is rotated to the actuated position. The drive assembly 180 is a mechanical linkage between the indenter actuator cam arm 170 and the drive screw 122 that converts rotating movement of the drive screw 122 to linear movement between the retracted position and the advanced position. The indenter actuator cam arm 170 is moved along the cam stroke until the locating surface 216 bottoms out against the stop surface 212 of the crimp height adjustment mechanism 146. The spring-loaded coupling 188 is compressed as the drive assembly 180 continues advancing to the advanced position after the indenter actuator cam arm 170 stops at the actuated position. The springs 200 are shown compressed by the second coupling plate 204 moving closer to the first coupling plate 202.

Figure 5:
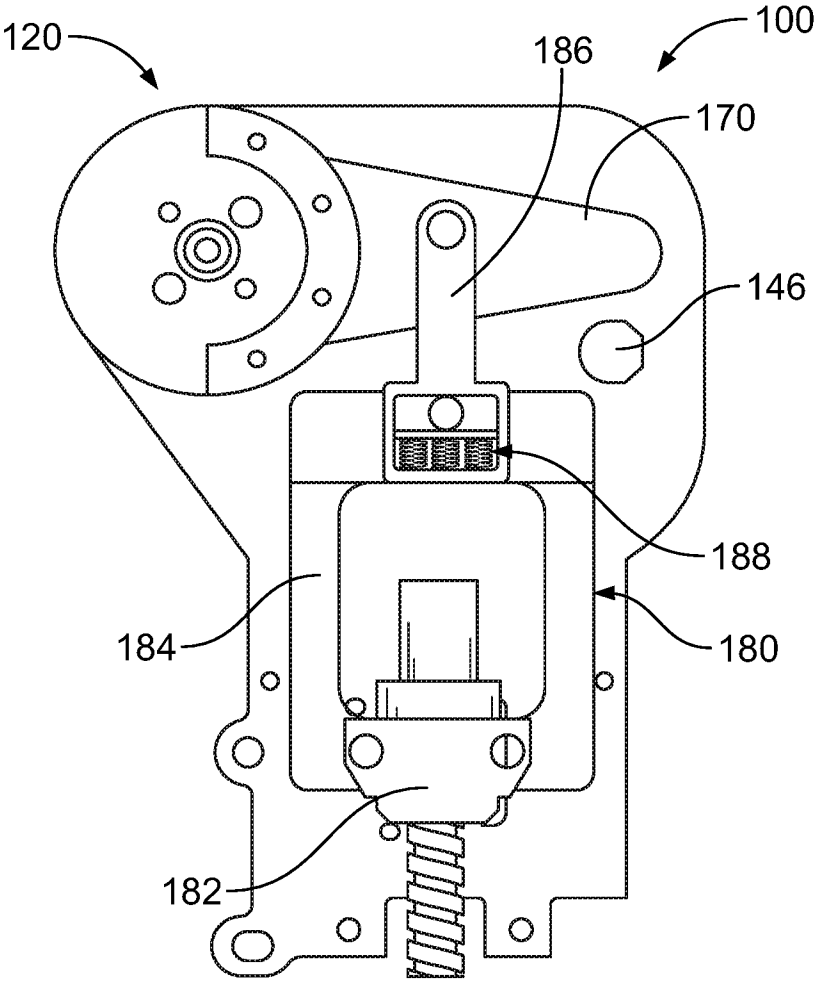
FIG. 5 is a side, partial sectional view of a portion of the 4-way indent tool in accordance with an exemplary embodiment.

FIG. 5 is a side, partial sectional view of a portion of the 4-way indent tool 100 showing the indenter assembly 120 and the drive assembly 180 with the spring loaded coupling 188 between the coupler 186 and the yoke 184. In the illustrated embodiment, the spring loaded coupling 188 allows the coupler 186 to move relative to the yoke 184 after the indenter actuator cam arm 170 bottoms out against the crimp height adjustment mechanism 146. The spring loaded coupling 188 decouples the coupler 186 from the yoke 184 and the drive nut 182, allowing the coupler 186 to remain fixed with the indenter actuator cam arm 170 at the actuated position while the yoke 184 and the drive nut 182 are able to continue to advance.

Figure 6:
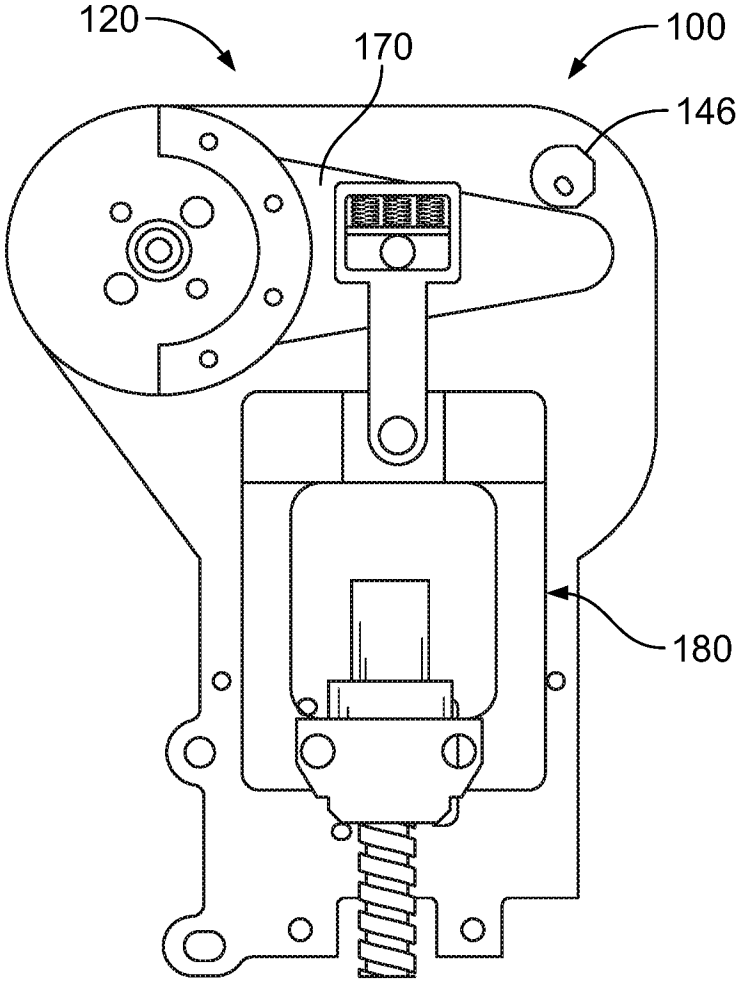
FIG. 6 is a side, partial sectional view of a portion of the 4-way indent tool in accordance with an exemplary embodiment.

FIG. 6 is a side, partial sectional view of a portion of the 4-way indent tool 100 showing the indenter assembly 120 arranged such that the drive assembly 180 is driven upward, rather than downward, from the unactuated position to the actuated position. In the illustrated embodiment, the crimp height adjustment mechanism 146 is provided above the indenter actuator cam arm 170. The indenter actuator cam arm 170 is rotated upward into the crimp height adjustment mechanism 146.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms “including” and “in which” are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A 4-way indent tool comprising:

a cover having a base and a head, the base holding a motor driven by a power source, the cover holding a drive screw operably coupled to the motor and being rotated by the motor when the motor is operated;

an indenter holder at the head, the indenter holder holding four indenters positioned orthogonally around a terminal opening configured to receive a terminal, the indenters being actuated to move relative to the terminal opening to crimp the terminal received in the terminal opening;

an indenter actuator cam arm positioned adjacent the indenter holder to operably engage the indenters, the indenter actuator cam arm being movable between an unactuated position and an actuated position, the indenter actuator cam arm having cam surfaces engaging the corresponding indenters to actuate the indenters as the indenter actuator cam arm moves to the actuated position; and a drive assembly movable along the drive screw between a retracted position and an advanced position, the drive assembly having a drive nut threadably coupled to the drive screw and a coupler operably coupled between the drive nut and the indenter actuator cam arm, the coupler moving the indenter actuator cam arm between the unactuated position and the actuated position as the coupler is moved between the retracted and advanced positions, the coupler having a spring loaded coupling between the drive nut and the indenter actuator cam arm compressed as the coupler is moved between the retracted position and the advanced position, the spring loaded coupling being configured to decouple the indenter actuator cam arm from the drive nut when the indenter actuator cam arm is in the actuated position to allow the coupler to continue moving to the advanced position without further moving the indenter actuator cam arm beyond the actuated position.

2. The 4-way indent tool of claim 1, wherein the spring loaded coupling includes a spring, a first coupling plate operably coupled to the drive nut and a second coupling plate operably coupled to the indenter actuator cam arm, the second coupling plate being movable relative to the first coupling plate, the spring being compressible between the first coupling plate and the second coupling plate as the coupler is moved between the retracted and advanced positions.

3. The 4-way indent tool of claim 1, wherein the drive assembly further comprises a yoke between the drive nut and the coupler.

4. The 4-way indent tool of claim 3, wherein the coupler is pivotably coupled to the yoke.

5. The 4-way indent tool of claim 3, wherein the spring loaded coupling is between the yoke and the coupler.

6. The 4-way indent tool of claim 1, wherein the spring loaded coupling is between the coupler and the indenter actuator cam arm.

7. The 4-way indent tool of claim 1, wherein the coupler includes frame members surrounding a pocket, the spring loaded coupling being positioned in the pocket, a coupling member of the indenter actuator cam arm extends into the pocket to engage the spring loaded coupling, the coupling member moving in the pocket as the spring loaded coupling is compressed.

8. The 4-way indent tool of claim 1, wherein the spring loaded coupling decouples the drive assembly from the indenter actuator cam arm allowing movement of the drive nut and the coupler without corresponding movement of the indenter actuator cam arm.

9. The 4-way indent tool of claim 8, wherein the indenter actuator cam arm reaches the actuated position and stops moving prior to the drive assembly reaching the advanced position.

10. The 4-way indent tool of claim 1, further comprising a crimp height adjustment mechanism variably positionable relative to the head, the indenter actuator cam arm bottoming out against the crimp height adjustment mechanism in the advanced position.

11. The 4-way indent tool of claim 10, wherein the crimp height adjustment mechanism includes a first stop surface and a second stop surface, the crimp height adjustment mechanism being movable between a first position and a second position, the indenter actuator cam arm having a locating surface, wherein the locating surface engages the first stop surface when the crimp height adjustment mechanism is in the first position and wherein the locating surface engages the second stop surface when the crimp height adjustment mechanism is in the second position.

12. The 4-way indent tool of claim 10, wherein the crimp height adjustment mechanism includes an eccentric dial having a plurality of stop surfaces at different radial positions from a rotation axis of the eccentric dial.

13. The 4-way indent tool of claim 1, wherein the indenter actuator cam arm includes a cam lever arm coupled to the spring loaded coupling, the drive assembly pulls the cam lever arm downward to rotate the indenter actuator cam arm.

14. The 4-way indent tool of claim 1, wherein the indenter actuator cam arm includes a cam lever arm coupled to the spring loaded coupling, the drive assembly pushes the cam lever arm upward to rotate the indenter actuator cam arm.

15. A 4-way indent tool comprising:

a cover having a base and a head, the base holding a motor driven by a power source, the cover holding a drive screw operably coupled to the motor and being rotated by the motor when the motor is operated;

an indenter holder at the head, the indenter holder holding four indenters positioned orthogonally around a terminal opening configured to receive a terminal, the indenters being actuated to move relative to the terminal opening to crimp the terminal received in the terminal opening;

an indenter actuator cam arm positioned adjacent the indenter holder to operably engage the indenters, the indenter actuator cam arm being movable between an unactuated position and an actuated position, the indenter actuator cam arm having cam surfaces engaging the corresponding indenters to actuate the indenters as the indenter actuator cam arm moves to the actuated position; and a drive assembly movable along the drive screw between a retracted position and an advanced position, the drive assembly having a drive nut threadably coupled to the drive screw and a coupler operably coupled between the drive nut and the indenter actuator cam arm, the coupler moving the indenter actuator cam arm between the unactuated position and the actuated position as the coupler is moved between the retracted and advanced positions, the coupler being configured to decouple the indenter actuator cam arm from the drive nut when the indenter actuator cam arm is in the actuated position to allow the coupler to continue moving to the advanced position without further moving the indenter actuator cam arm beyond the actuated position.

16. The 4-way indent tool of claim 15, wherein the indenter actuator cam arm reaches the actuated position and stops moving prior to the drive assembly reaching the advanced position.

17. The 4-way indent tool of claim 15, wherein the coupler includes a spring loaded coupling having a spring, a first coupling plate operably coupled to the drive nut and a second coupling plate operably coupled to the indenter actuator cam arm, the second coupling plate being movable relative to the first coupling plate, the spring being compressible between the first coupling plate and the second coupling plate as the coupler is moved between the retracted position and the advanced position.

18. The 4-way indent tool of claim 15, further comprising a crimp height adjustment mechanism variably positionable relative to the head, the indenter actuator cam arm bottoming out against the crimp height adjustment mechanism in the advanced position.

19. A 4-way indent tool comprising:

a cover having a base and a head, the base holding a motor driven by a power source, the cover holding a drive screw operably coupled to the motor and being rotated by the motor when the motor is operated;

an indenter holder at the head, the indenter holder holding four indenters positioned orthogonally around a terminal opening configured to receive a terminal, the indenters being actuated to move relative to the terminal opening to crimp the terminal received in the terminal opening;

a crimp height adjustment mechanism variably positionable relative to the head;

an indenter actuator cam arm positioned adjacent the indenter holder to operably engage the indenters, the indenter actuator cam arm being movable between an unactuated position and an actuated position, the indenter actuator cam arm having cam surfaces engaging the corresponding indenters to actuate the indenters as the indenter actuator cam arm moves to the actuated position, the indenter actuator cam arm bottoming out against the crimp height adjustment mechanism in the actuated position, wherein the actuated position is variable and controlled by the position of the crimp height adjustment mechanism; and a drive assembly movable along the drive screw between a retracted position and an advanced position, the drive assembly having a drive nut threadably coupled to the drive screw and a coupler operably coupled between the drive nut and the indenter actuator cam arm, the coupler moving the indenter actuator cam arm between the unactuated position and the actuated position as the coupler is moved between the retracted and advanced positions, the coupler having a spring loaded coupling between the drive nut and the indenter actuator cam arm compressed after the indenter actuator cam arm bottoms out against the crimp height adjustment mechanism as the coupler continues to move toward the advanced position.

20. The 4-way indent tool of claim 19, wherein the crimp height adjustment mechanism includes a first stop surface and a second stop surface, the crimp height adjustment mechanism being movable between a first position and a second position, the indenter actuator cam arm having a locating surface, wherein the locating surface engages the first stop surface when the crimp height adjustment mechanism is in the first position and wherein the locating surface engages the second stop surface when the crimp height adjustment mechanism is in the second position.

* * * * *